United States Patent [19]

Quehen

[11] 4,187,707

[45] Feb. 12, 1980

[54] THICKNESS CONTROL METHOD AND APPARATUS FOR A ROLLING MILL

[75] Inventor: André Quehen, Paris, France

[73] Assignee: SECIM, Courbevoie, France

[21] Appl. No.: 945,674

[22] Filed: Sep. 25, 1978

[30] Foreign Application Priority Data

Sep. 26, 1977 [FR] France ..... 77 28873

[51] Int. Cl.[2] ..... B21B 37/00

[52] U.S. Cl. ..... 72/8; 72/21; 72/205

[58] Field of Search ..... 72/19, 20, 21, 8, 6, 72/17, 11, 9

[56] References Cited

U.S. PATENT DOCUMENTS

| | | | |
|---|---|---|---|
| 3,357,217 | 12/1967 | Wallace et al. | 72/8 |
| 3,550,414 | 12/1970 | List | 72/8 |
| 3,782,151 | 1/1972 | Peterson et al. | 72/9 |
| 3,808,858 | 5/1974 | Connors et al. | 72/8 |
| 4,033,492 | 7/1977 | Imai | 72/17 X |

*Primary Examiner*—Milton S. Mehr

*Attorney, Agent, or Firm*—Daniel Patch; Suzanne Kikel

[57] ABSTRACT

This disclosure relates to a process for the regulation of the thickness of a flat product such as a strip, sheet or plate, being rolled in a hot tandem rolling mill, and the corresponding regulation device for carrying out the process. Regarding each stand of the rolling mill on which the adjustment is being performed, a constant rolling pressure is maintained, the gap is measured, the deviation between the measured gap and a set value corresponding to a desired thickness of the product is determined, and the necessary correction of the value of the tensile force applied on the product between the stand under consideration and the upstream stand in order to bring the gap back to its set value is determined. Finally, this correction of the tensile force between the stand under consideration and the upstream stand is performed.

10 Claims, 3 Drawing Figures

Figure 1:
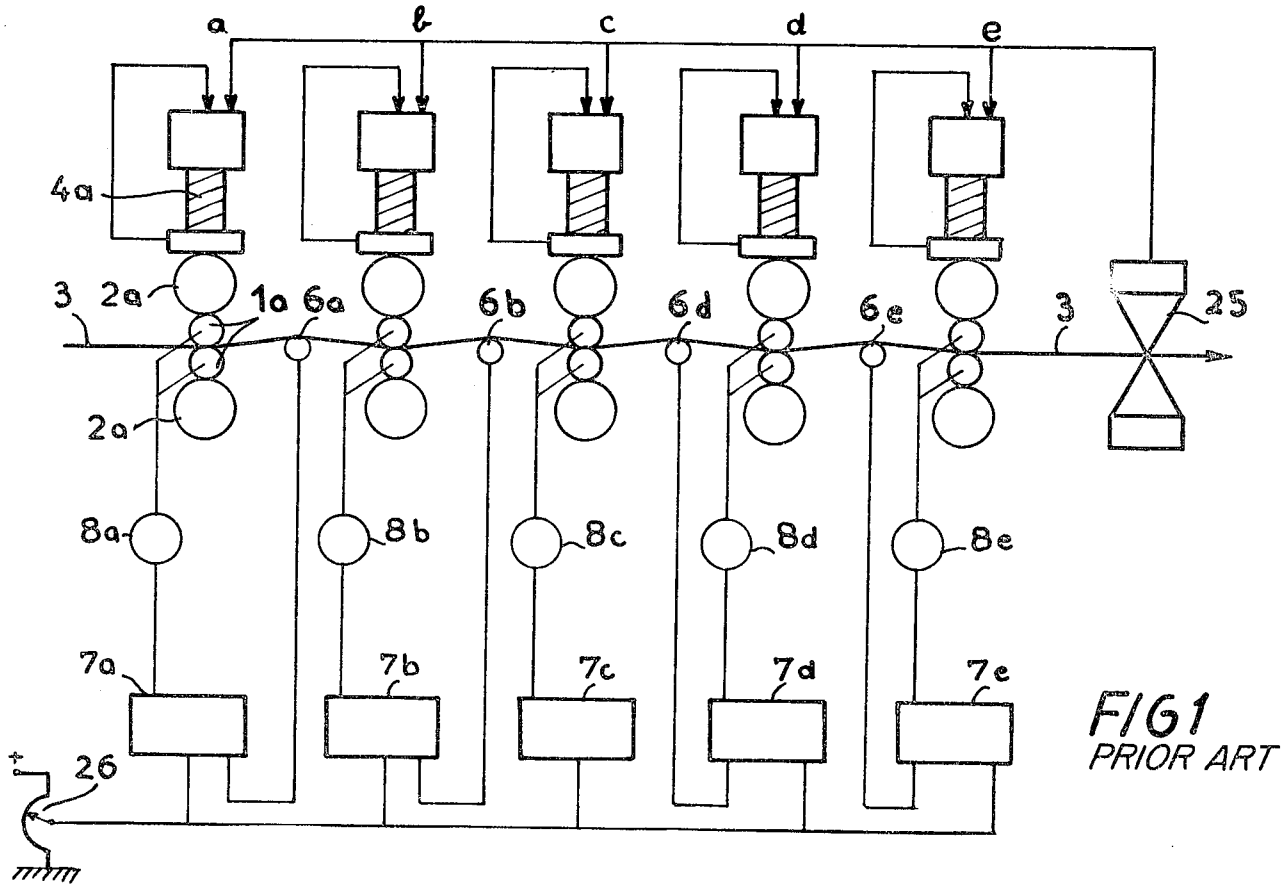
FIG 1 PRIOR ART

V = V₀ + ΔV
V₀
37b
38b
33
31b
30b
40b
41b
ΔV
54
32b
43
42
ΔPos
44b
45b
M
P
T₀
48
ΔT
f(e,l,t,Δe₂)
Δe₂
Pos 0
P2
ΔP₂
P₀2
49
50
T₀+ΔT
39
47
51
52
ΔP₂ = f(e,l,t,ΔT)
e
l
t
36
32a
33
41
45a
37a
38a
33
31a
30a
43
44a
P₀1

THICKNESS CONTROL METHOD AND APPARATUS FOR A ROLLING MILL

The invention covers a process for the regularization of the thickness of a flat product in the course of being rolled in a hot tandem rolling mill, together with the corresponding apparatus or installation. During the rolling of a flat product, such as a strip, sheet or plate, in a hot tandem rolling mill, it is necessary to maintain the thickness of the product emerging from the tandem mill constant.

In the case of the hot tandem rolling mill, the most frequently used technique, until now, consists in providing all the stands of the rolling mill, or a number of them, with a gap regulation device maintaining the space between the working rolls of the stand under consideration to a constant value, whatever the variations in the rolling force are.

Furthermore, one of the stands, called a pilot stand, has a fixed speed relative to the general set speed of the tandem mill. The speed of the other stands is regulated relative to the speed of the pilot stand in order to maintain a tensile force in the strip between the stands that is almost constant. For that purpose, tension rolls parallel to the working rolls are arranged between the stands on a moving support which provides for their vertical movement in order to produce a deflection of the strip relative to the level of the corresponding working roll. These adjustment rolls and their moving support, called loopers, provide for a control of the height of the loops on the strip between the stands while maintaining a constant tensile force in the strip, as each one of these loopers produces, according to the variations of the roll position, an action on the speed of the rolling mill stands. This action on the stand speeds takes place on the stands located upstream of the looper, if this looper is itself arranged upstream of the pilot stand; otherwise, it takes place on those stands located downstream from the looper, if the looper is located downstream from the pilot stand in the rolling direction. However, this regulation technique has disadvantages, as the temperature variations in the rolled strips, according to their length, result in variations in the rolling force that fluctuates widely, and this results in variations of roll deflection of the rolling mill rolls which are subjected to these variations of the rolling force.

These roll deflection variations hence produce variations in the profile of the rolled strip in the transversal direction. These phenomena get larger at the level of the last delivery stand of the tandem mill rolling thin strip due to the increase in the hardness of the metal as it cools and is work hardened. In some cases, the regulation of a set of a rather large number of stands may be difficult to implement for stability reasons.

The purpose of the invention is thus to propose a process and an apparatus for the regulation of the thickness of a flat product in the course of being rolled in a hot tandem rolling mill, providing for a thickness regulation without wide variations of the rolling force and with good stability conditions. For that purpose, the following operations are continuously performed on each one of the rolling mill stands on which the adjustment is taking place, the following operations being: maintaining a constant rolling pressure; measuring the gap, or its variation, that is the space existing between the working rolls of the stand under consideration; determining the deviation between the measured gap and a set value selected for the gap which set value corresponds to a desired thickness of the product, depending upon the thickness, the width and the temperature of the flat product, and depending upon the deviation of the measured gap from the set value, determining the necessary correction on the value of the tensile force applied on the strip between the stand under consideration and the stand located immediately upstream, in order to bring the gap back to its set value and performing the correction of the tensile force on the strip between the stand under consideration and the upstream stand.

As a non-limiting example, an installation providing for the thickness regulation according to the old method, and, as a comparison, an installation providing for the thickness regulation in accordance with the process of the present invention will now be given.

Figure 2:
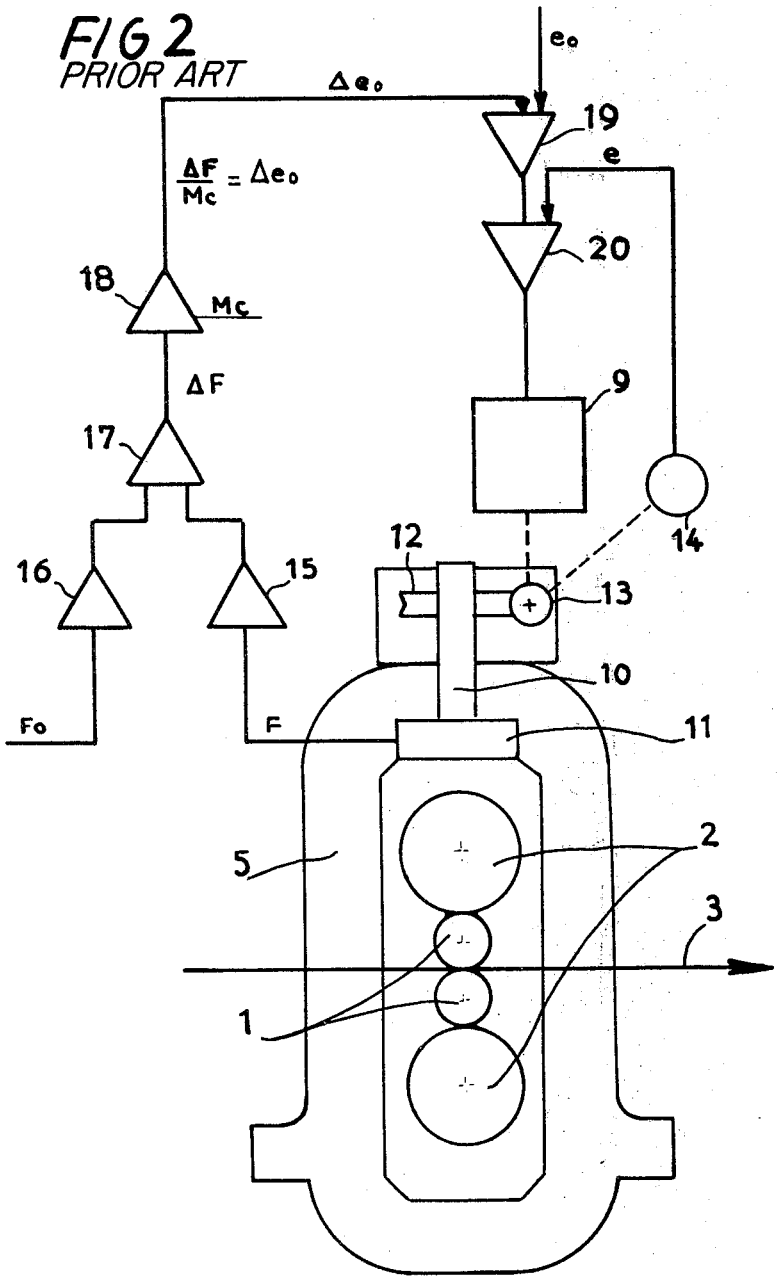
FIG 2 PRIOR ART
Figure 3:
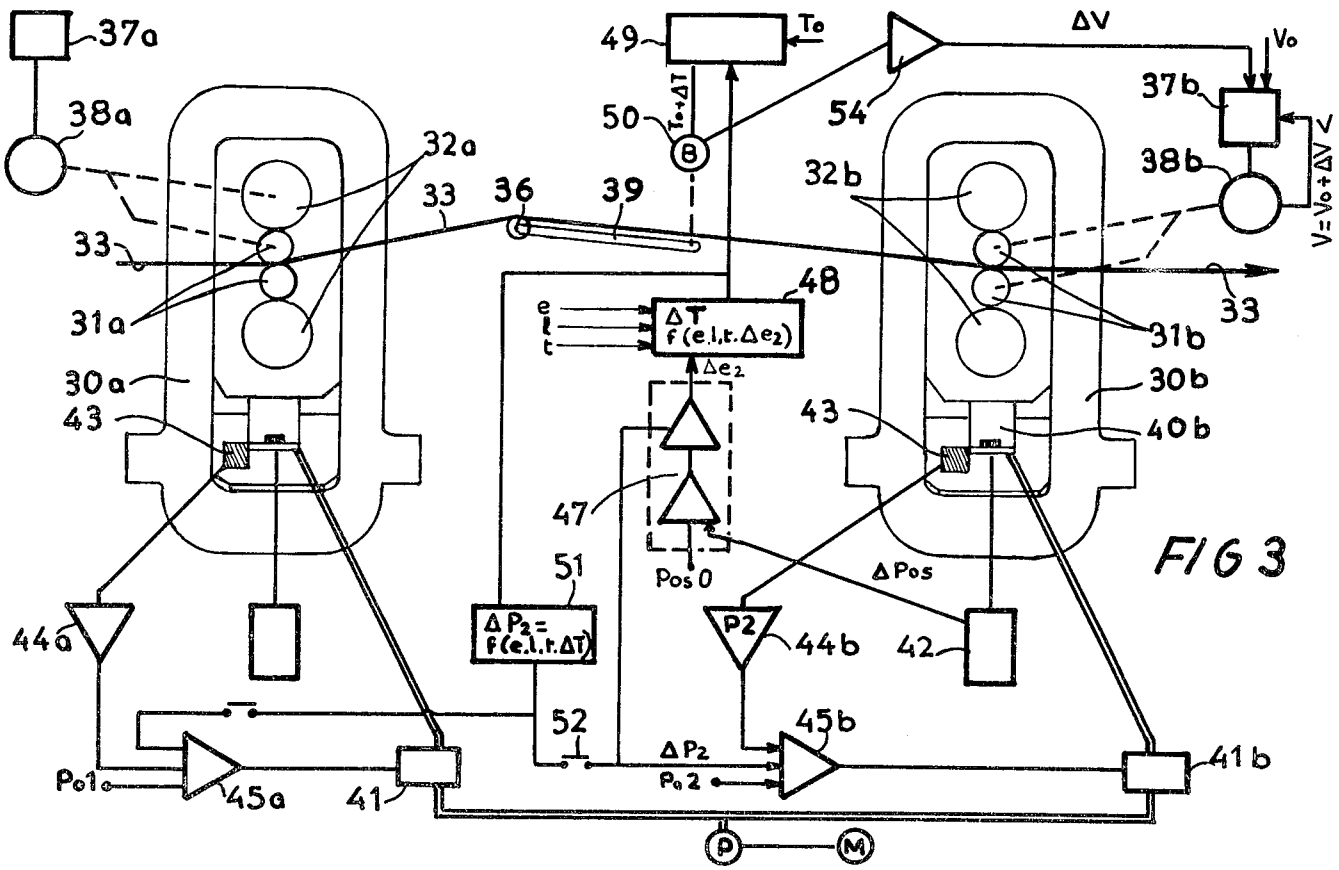

FIG. 1 represents schematically a 5-stand hot tandem finishing mill provided with a regulation device in accordance with the known method;

FIG. 2 schematically represents the regulation device for some of the stands of the hot tandem rolling mill shown in FIG. 1; and FIG. 3 schematically represents two stands of a hot tandem finishing rolling mill provided with a regulation device implementing the process of the present invention.

In FIG. 1, each one of the stands is designated by a, b, c, d or e, and the corresponding elements of each one of the stands, in addition to bearing one of these marks, bears a number. It is to be understood that identical elements of all stands are designated by the same number, but different letters. Also, in describing the elements appearing in the Figures, only the general case numbers will be noted even though the Figures shown specific case numbers, for instance, 1*a*, 6*b*, etc. Each one of the stands comprises two working rolls 1, and two back-up rolls 2. The strip 3 being rolled passes between the working rolls 1. Each one of the stands comprises a device 4 for the gap adjustment intended to keep this gap constant whatever the variations of the rolling force are. The thickness of the strip thus remains constant relative to each one of the stands. The device 4 shall be described in more detail later in referring to FIG. 2. Between each one of the stands and each one of the adjacent stands, a looper roll 6 shown in FIG. 1 is arranged on a moving support moving in the vertical direction in order for the adjustment of the loop produced by the strip between any two stands. Generally, a signal representing the position of the looper in the vertical direction is transmitted to a speed regulator 7 acting on the motor 8 driving the working rolls of a stand located upstream or downstream of roll 6*a*, depending on the location of the pilot stand to whose speed the speeds of the other stands are regulated. In this FIG. 1, stand c is the pilot stand. The loopers 6*a* and 6*b* which are located upstream of stand c act through the speed regulators 7*a* and 7*b* on the motors 8*a* and 8*b* of the two stands "a" and "b" located upstream of the rolls 6*a* and 6*b*, respectively. The loopers 6*d* and 6*e* located downstream of stand c act through the speed regulators 7*d* and 7*e* on the motors 8*d* and 8*e* of stands "d" and "e" located downstream of rolls 6*d* and 6*e*, respectively. Each one of the speed regulators 7*a*, 7*b*, 7*d* and 7*e* furthermore receives a signal corresponding to the reference speed of the reference stand c, which may be modulated through a potentiometer 26 and which is added to each one of the regulators 7*a*, 7*b*, 7*d* and 7*e* to the signal representative of the position of the corresponding looper roll. Depending upon those two signals, each one of the speed regulators regulates the corresponding drive motor in order to produce a constant loop height, on the average, between each stand, the value of the tensile force inside the strip being furthermore kept constant whatever the loop height is. With reference now to the gap regulation system shown in 4 of FIG. 1 reference is made to FIG. 2. This device includes an adjustment screw 10 integral with a screw-nut system 12–13 driven by a motor 9 which arrangement allows a controlled rolling force to be applied to each chock of the upper roll, through the device 12–13 of screw 10 and through a loading cell 11, a position sensor 14 sends continuously the value of the gap or its variations.

Also, the value of the rolling force F is continuously monitored through the loading cell 11, which value is compared with the set value Fo for this rolling force through the electronic devices 15, 16 and 17. Device 17 generates a signal representing the variation of the rolling force ΔF. This signal is sent to a device 18 which also receives a signal representative of the modulus Mc of the stand in order to produce a signal, $\Delta F/Mc=\Delta e_o$, representing the absolute value of the screw correction corresponding to the compensation of the stand yield. Device 19 enables us to perform that correction relative to the value of the signal "$e_o$" representing the no-load gap adjustment, the resulting signal being compared at the level of a device 20 with the gap measurement signal "e" produced by sensor 14. According to the results of the comparison of these two signals, device 20 orders the screw motor 9 to perform the correction through action on the chock of the rolling roll, by means of the loading cell 11 located between the stationary frame 5 of the stand and the corresponding chock. This arrangement in FIG. 2 continuously compensates for the yielding of the stand in accordance with the variations of the rolling force. Indeed, the general equation of the movement is as follows:

$$e=e_o=F/Mc$$

$$\Delta e=\Delta e_o+(\Delta F/Mc)=0$$

$$e_o=-\Delta F/Mc$$

in which $e_o$ is the no-load gap setting.

$\Delta e_o$ is the tightening correction corresponding to the compensation.

F is the rolling force.

ΔF is the variation of the rolling force.

Mc is the yielding modulus for the stand.

Consequently, in order that the initial thickness "e" remains unchanged, the equation $\Delta e=-\Delta F/Mc$ must continuously be maintained. In FIG. 1 a device 25 comprising a thickness measurement gage is used in order to check the efficiency of the system and to modify the value of the gap for the last stands.

The known device as shown in FIGS. 1 and 2 has the disadvantage that it operates with a variable rolling force F with the attendant limitation outlined above that flow from normal roll deflection. In FIG. 3, there is schematically shown two stands of a tandem mill, in which stand a is the pilot stand relative to which the speed regulation is performed, and stand b is the stand which comprises a regulation system in accordance with the teaching of the present invention. Each stand includes a frame 30, working rolls 31, and back-up rolls 32. The working rolls are driven by a motor 38 driven through a speed regulator 37. The strip 33 being rolled passes between the working rolls 31 and on a looper roll 36 mounted at the end of an oscillating arm 39 articulated at one of its ends on a stationary shaft.

The stands "a" and "b" shown in FIG. 3 are hydraulic roll adjusting stands including a roll adjusting jack 40 supplied by a servo valve 41. A displacement sensor 42 generates a signal that is a function of the displacement of the moving part of the jack 40 connected to a chock of a lower roll of the rolling mill. The signal produced by the sensor 42 is thus a function of the value of the gap, as the position of the upper roll of the rolling mill stand is stationary. A sensor 43 furthermore provides for the generation of a signal corresponding to the rolling pressure P through an electronic device 44. A pressure regulator 45 acting on the servo valve 41 keeps the rolling pressure constant. For that purpose, the pressure regulator 45, in addition to receiving a signal representative of the rolling force P, receives a signal corresponding to the set value of the rolling force. The signal generated by the sensor 42 in response to the gap variations is transmitted to a computing device 47 which enables a determination, from this signal and from a signal corresponding to the selected set value of the gap of a value representative of the thickness of the rolled strip and a conversion of this value into signal $\Delta e_2$ that is a function of the deviation between the measured gap and the set value Pos O for that gap, A preprogrammed function computer 48 calculates, from the values of the thickness e, the width 1 and the temperature t of the strip and the previously calculated gap deviation $\Delta e_2$, the value of the modification of the tensile force applied on the strip by the looper 39 in order to keep the gap at its set value that is determined by the desired delivery thickness for the strip. The signal ΔT representing the value of the modification of the tensile force that is required is sent to a device 49 which also receives the set value of the tensile force To on the strip. Device 49 generates a signal corresponding to the modified tensile force which is sent to the motor 50 in order to provide for the application of a force by the looper roll 36 on the strip in order to modify the tensile force on the strip in accordance with the determined value. The variation ΔT of the tensile force must however be kept within given limits in order that the tensile force applied allows a continuous operation under normal rolling conditions for the product.

The tensile force is kept within these limits by a supplementary and progressive action on the rolling force of stand "b", beyond a given correction threshold ΔT for the tensile force. This supplementary action on the rolling force is developed by the function computer 51 which provides a signal corresponding to the variation of rolling pressure ΔP required in order to bring back the tensile force to its set value as a function of the thickness, the width and the temperature of the strip, and of the variation of the tensile force required in order to maintain the gap at its set value. A switch 52 provides, in the case where the permissible value for the correction of the strip tensile force is exceeded, for the transmission of the signal representing ΔP on the one hand to the pressure regulator 45 and on the other hand to the function computer 47 which introduces these corrective terms in the calculation and in the generation of the signal corresponding to the gap correction.

During all these operations, the position of the looper remains controlled by the action of a position error signal on the speed of the motor 38*b* for stand b, through a device 54 and through the speed regulator 37*b* receiving the speed signal Vo and the correction ΔV whose signal is generated by the device 54 from the position error of the motor 50. In the example which has just been described, stand "b" comprises all the regulation devices providing for the implementation of the process according to the invention. On the other hand, stand "a", or the pilot stand, includes only a device for the regulation of the rolling pressure which is appreciably similar to that of stand "b", a device for the measurement of the gap variations, and a speed regulator for the drive motor for the working rolls of the stand. A connection of the pressure regulator 45 of stand a with the function generator 51 also enables a taking into account of the modifications of the rolling pressure performed by stand "b" for the determination of the rolling pressure of stand "a".

The apparatus and the process according to the present invention thus enables the operation of the rolling mill with a constant rolling pressure and to correct the gap errors through variations of the tensile force on the strip between the stands, with a supplementary correction of the rolling pressure when the required tensile force correction is too large.

It is known that the efficiency of the variation of the tensile force in the strip in order to correct thickness variations varies as the inverse of the strip thickness. On the other hand, the influence of those variations of tensile force on the variation of width of the hot product varies in the same direction as the thickness of the product. The thickness control system which has just been described shall thus be efficient on the thickness while remaining practically without any adverse effect on the width of the product, provided that this product is sufficiently thin. In the case of a hot finishing tandem rolling mill, it may thus be interesting to use together various types of devices and to perform the regulations in different manners, depending upon the thickness of the strip relative to or with respect to the stand under consideration.

One type and manner in a tandem stand hot finishing strip mill would be to control the roll gap by constant roll gap control in the first stands and control the roll gap by strip tension control and roll adjusting force control in accordance with the teaching of the present invention in the last stands and finally, to control the roll screwdown gap by roll adjustment supplemented by variations in the strip tension in the intermediate stands. If a modification of the rolling force or roll adjusting force of the last stand(s) of the rolling mill is to be avoided, it is possible, when the limits of possible action on the tensile force for the thickness regulation is reached to modify the roll adjustment effort for the stands upstream of the regulated stand as a function of the residual gap error with respect to the stand under consideration. This action shall however have to take into account the transfer time between the roll adjustment of the upstream stand and its action on the regulated stand. Thus full advantage of the regulation system which aims at rolling a strip with a constant profile and thickness in the transversal direction, while keeping constant the rolling force in the last stand(s) can be taken.

However, the invention is not limited to this example of development which has just been described. In fact it includes all its variations. For instance the looper devices arranged between the stands can be replaced with tensiometers, and the gap correction signal can be set up to act to vary the upstream tensile force through direct action on the speed of the motor of the stand under consideration, or of the stand which is located immediately upstream. As mentioned, the example of development which has just been described covers rolling mill stands with hydraulic roll adjustment. It is however possible to apply the invention to the case of stands with a mechanical roll adjustment by screws such as those described in the example which are part of the previous practice presentation. Finally, the invention applies to any type of hot tandem rolling mills for metal strips, for which it is desired to regulate the thickness, while avoiding the disadvantages of a variation of the rolling pressure, especially in the last stands.

In accordance with the provisions of the patent statutes, I have explained the principle and operation of my invention and have illustrated and described what I consider to represent the best embodiment thereof.

I claim:

1. A process for controlling the thickness of a flat product being rolled by a continuous hot tandem rolling mill having a first reference stand, and a second reference stand upstream from said first reference stand in which the following steps are continuously performed:

with respect to at least said first stand, maintaining a constant rolling pressure on the product as it passes between the rolls thereof, measuring the gap or a change in the gap between the work rolls of said first reference stand, producing a signal representative of the difference between the measured roll gap value for said first reference stand and a selected gap value for said first reference stand, which signal corresponds to the amount the rolled thickness produced by said first reference stand differs from the desired thickness for the product issuing from said first reference stand, employing said difference signal by itself or with other variables such as thickness, width or temperature of the product to produce a signal representing the corrective tensile force that must be exerted on the product as it passes between said first and second reference stands to cause the roll gap of said first reference stand to be adjusted until it produces a product of said desired thickness, and employing said tensile force signal to operate a means for exerting a tensile force on said product passing between said first and second reference stands for effecting said gap adjustment.

2. A process for controlling according to claim 1, wherein said first and second reference stands are the last two stands of said tandem mill having at least three stands.

3. A process for controlling the thickness of a flat product being rolled by a continuous hot tandem rolling mill having a first reference stand, and a second reference stand upstream from said first reference stand in which the following steps are continuously performed:

with respect to at least said first stand, maintaining a constant rolling pressure on the product as it passes between the rolls thereof, measuring the gap or a change in the gap between the work rolls of said first reference stand, producing a signal representative of the difference between the measured roll gap value for said first reference stand and a selected gap value for said first reference stand, which signal corresponds to the amount the rolled thickness produced by said first reference stand differs from the desired thickness for the product issuing from said first reference stand, employing said difference signal by itself or with other variables such as thickness, width or temperature of the product to produce a signal representing the corrective tensile force that must be exerted on the product as it passes between said first and second reference stands to cause the roll gap of said first reference stand to be adjusted until it produces a product of said desired thickness, and employing said tensile force signal to operate a means located between said first and second reference stands for exerting a tensile force on said product for effecting said gap adjustment.

4. A process for controlling according to claim 3 including the additional step of:

employing said tensile force signal to change the rolling pressure of the work rolls of either said reference stands to a different constant rolling pressure value when said corrective tensile force exceeds a given range in order to keep the roll gap of said first reference stand constant.

5. A process for controlling the thickness of a flat product being rolled by a continuous hot tandem rolling mill having a first reference stand, and a second reference stand upstream from said first reference stand in which the following steps are continuously performed:

with respect to at least said first stand, maintaining a constant rolling pressure on the product as it passes between the rolls thereof, measuring the gap or a change in the gap between the work rolls of said first reference stand, producing a signal representative of the difference between the measured roll gap value for said first reference stand and a selected gap value for said first reference stand, which signal corresponds to the amount the rolled thickness produced by said first reference stand differs from the desired thickness for the product issuing from said first reference stand, employing said difference signal by itself or with other variables such as thickness, width or temperature of the product to produce a signal representing the corrective tensile force that must be exerted on the product as it passes between said first and second reference stands to cause the roll gap of said first reference stand to be adjusted until it produces a product of said desired thickness, measuring a tensile force on said product passing between said first and second reference stands, producing a signal representative of said tensile force, and employing said corrective tensile force signal and said measured tensile force signal to produce a signal to change the speed of the work rolls of either said first or second reference stands to effect said gap adjustment of said first reference stand.

6. An apparatus for controlling the thickness of a flat product being rolled by a continuous hot tandem rolling mill having a first reference stand, and a second reference stand upstream from said first reference stand, comprising:

with respect to at least said first reference stand, means for maintaining a constant rolling pressure on the product as it passes between the rolls thereof, means for measuring the gap or a change in the gap between the work rolls of said first reference stand, means connected to said gap measuring means of said first reference stand for producing a signal representative of the difference between the measured gap value for said first reference stand and a selected gap value for said first reference stand, which signal corresponds to the amount the rolled thickness produced by said first reference stand differs from the desired thickness for the product issuing from said first reference stand, means for receiving said gap difference signal and for employing said difference signal by itself, or with other variables such as thickness, width or temperature of the product to produce a signal representing the corrective tensile force that must be exerted on the product as it passes between said first and second reference stands to cause the roll gap of said first reference stand to be adjusted until it produces a product of said desired thickness, and means for employing said tensile force signal to exert a tensile force on said product passing between said first and second reference stands.

7. An apparatus for controlling according to claim 6, wherein said first and second reference stands are the last two stands of said tandem mill having at least three stands.

8. An apparatus for controlling the thickness of a flat product being rolled by a continuous hot tandem rolling mill having a first reference stand, and a second reference stand upstream from said first reference stand comprising:

with respect to at least said first reference stand, means for maintaining a constant rolling pressure on the product as it passes between the rolls thereof, means for measuring the gap or a change in the gap between the work rolls of said first reference stand, means connected to said gap measuring means of said first reference stand for producing a signal representative of the difference between the measured gap value for said first reference stand and a selected gap value for said first reference stand, which signal corresponds to the amount the rolled thickness produced by said first reference stand differs from the desired thickness for the product issuing from said first reference stand, means for receiving said gap difference signal and for employing said difference signal by itself, or with other variables such as thickness, width or temperature of the product to produce a signal representing the corrective tensile force that must be exerted on the product as it passes between said first and second reference stand to cause the roll gap of said first reference stand to be adjusted until it produces a product of said desired thickness, means located between said first and second reference stands and arranged to exert a tensile force on said product, and means for receiving said corrective tensile force signal and for employing said tensile force signal to operate said force exerting means to effect said gap adjustment of said first reference stand.

9. An apparatus according to claim 8 further comprising:

means for employing said tensile force signal to change the rolling pressure of said work rolls of either said reference stands to a different constant rolling pressure value when said corrective tensile force exceeds a give range in order to keep the roll gap of said first reference stand constant.

10. An apparatus for controlling the thickness of a flat product being rolled by a continuous hot tandem rolling mill having a first reference stand, and a second reference stand upstream from said first reference stand comprising:

with respect to at least said first reference stand, means for maintaining a constant rolling pressure on the product as it passes between the rolls thereof, means for measuring the gap or a change in the gap between the work rolls of said first reference stand, means connected to said gap measuring means of said first reference stand for producing a signal representative of the difference between the measured gap value for said first reference stand and a selected gap value for said first reference stand, which signal corresponds to the amount the rolled thickness produced by said first reference stand differs from the desired thickness for the product issuing from said first reference stand, means for receiving said gap difference signal and for employing said difference signal by itself, or with other variables such as thickness, width or temperature of the product to produce a signal representing the corrective tensile force that must be exerted on the product as it passes between said first and second reference stands to cause the roll gap of said first reference stand to be adjusted until it produces a product of said desired thickness, a tensiometer means arranged between said first and second reference stands for measuring a tensile force on said product and for producing a signal representative of said tensile force, and means for receiving said corrective tensile force signal and said measured tensile force signal to produce a signal to change the speed of the work rolls of either said first or second reference stands to effect said gap adjustment of said first reference stand.

* * * * *